US009557036B2

(12) United States Patent
Pasqualini et al.

(10) Patent No.: US 9,557,036 B2
(45) Date of Patent: Jan. 31, 2017

(54) LIGHTING DEVICE AND ASSOCIATED METHOD

(71) Applicant: OSRAM GmbH, Munich (DE)

(72) Inventors: Dina Pasqualini, Udine (IT); Mario Boehmer, Altomuenster (DE); Simon Bobbo, Chirignago (IT); Simone Capeleto, Padua (IT); Alberto Alfier, Vedelago (IT)

(73) Assignee: OSRAM GmbH, Munich (DE)

( * ) Notice: Subject to any disclaimer, the term of this patent is extended or adjusted under 35 U.S.C. 154(b) by 283 days.

(21) Appl. No.: 13/714,005

(22) Filed: Dec. 13, 2012

(65) Prior Publication Data

US 2013/0148349 A1 Jun. 13, 2013

(30) Foreign Application Priority Data

Dec. 13, 2011 (IT) ..... TO2011A1142

(51) Int. Cl.

| | |
|---|---|
| ***F21V 11/00*** | (2015.01) |
| ***F21V 14/00*** | (2006.01) |
| ***F21V 5/00*** | (2015.01) |
| ***F21V 5/02*** | (2006.01) |
| ***F21V 17/00*** | (2006.01) |
| ***F21V 17/10*** | (2006.01) |

(52) U.S. Cl.

CPC ..... *F21V 14/006* (2013.01); *F21S 4/20* (2016.01); *F21S 4/28* (2016.01); *F21V 5/00* (2013.01); *F21V 5/02* (2013.01); *F21V 17/002* (2013.01); *F21V 17/104* (2013.01)

(58) Field of Classification Search

CPC ..... F21V 14/006; F21V 5/02; F21V 5/00; F21V 17/002; F21V 17/104; F21S 4/008; F21S 4/003; F21S 4/20; F21S 4/28

USPC ..... 362/235, 246, 244, 217.01, 223, 224,362/217.1, 227, 249.02, 311.01, 311.02, 222,362/355, 356, 311.06, 311.14, 311.15

See application file for complete search history.

(56) References Cited

U.S. PATENT DOCUMENTS

| | | | | |
|---|---|---|---|---|
| 3,460,299 | A * | 8/1969 | Wilson | 52/144 |
| 6,705,742 | B1 * | 3/2004 | Patterson et al. | 362/224 |
| 7,667,904 | B2 * | 2/2010 | Lewis | B60K 35/00 340/426.24 |
| 7,710,663 | B2 * | 5/2010 | Barnes et al. | 359/720 |
| 2009/0185379 | A1 * | 7/2009 | Chen | 362/294 |
| 2010/0073929 | A1 * | 3/2010 | Gingrich, III | F21S 2/005 362/249.01 |
| 2010/0118564 | A1 | 5/2010 | Shen et al. | |

(Continued)

FOREIGN PATENT DOCUMENTS

| | | |
|---|---|---|
| CN | 101886753 | 11/2010 |
| CN | 202032476 | 11/2011 |
| DE | 20 2009 008 330 | 8/2009 |

*Primary Examiner* — Laura Tso
*Assistant Examiner* — Naomi M Wolford
(74) *Attorney, Agent, or Firm* — Cozen O'Connor

(57) ABSTRACT

A lighting device comprises a housing carrying a linear array of light radiation sources and one or more elongated diffusive screens arranged facing the array of light sources so as to be passed through by the light radiation. The screen or screens have a pattern of geometric features for producing a radiation pattern of the light radiation emitted by the lighting device as a result of passing through the diffusive screen or screens. By replacing the diffusive screen or screens with screens which have a different pattern of geometric features it is possible to vary the radiation pattern of the light radiation emitted by the lighting device.

6 Claims, 7 Drawing Sheets

(56) References Cited

U.S. PATENT DOCUMENTS

2010/0284195 A1 11/2010 Liu et al.
2010/0296279 A1* 11/2010 Ko ..... 362/231

* cited by examiner

LIGHTING DEVICE AND ASSOCIATED METHOD

RELATED APPLICATIONS

This application claims the priority of Italy application no. TO2011A001142 filed Dec. 13, 2011, the entire content of which is hereby incorporated by reference.

FIELD OF THE INVENTION

The invention relates to lighting devices.

Various embodiments may refer to lighting devices which use LED sources as light radiation sources.

BACKGROUND OF THE INVENTION

In the constructional design of lighting devices using, as a light radiation source, linear modules or arrays, for example of the LED types, it is possible to use optical systems (lenses or mirrors, singly or in an array) which produce at the output of the device a fixed light beam.

In order to modify the features of the radiation beam emitted the optical component must be changed, which may take time and not always be possible, thereby making it necessary to replace the entire module.

In various solutions it is possible to move away from or towards the light radiation source an optical component such as a lens. This allows one to obtain light beams only of circular shape, unless more complex systems are used.

SUMMARY OF THE INVENTION

One object of the invention is to overcome the above-mentioned drawbacks.

One aspect of the invention is directed to a lighting device comprising a housing for carrying a linear array of light radiation sources and at least one elongated diffusive screen arranged facing said array of light radiation sources so as to be passed through by the light radiation emitted by the array of light radiation sources. The diffusive screen has a pattern of geometric features for producing a radiation pattern of the light radiation emitted by the lighting device as a result of passing through the at least one diffusive screen, wherein the housing comprises supporting means for replaceably supporting the at least one diffusive screen, allowing replacement of the at least one diffusive screen with a diffusive screen having a different pattern of geometric features so as to vary the radiation pattern of the light radiation emitted by the lighting device.

Another aspect of the invention is directed to a method for varying the radiation pattern of the light radiation emitted by a lighting device comprising a linear array of light radiation sources and at least one elongated diffusive screen arranged facing the array of light radiation sources so as to be passed through by the light radiation emitted by the array of light radiation sources. The diffusive screen has a pattern of geometric features for producing the radiation pattern of the light radiation emitted by the lighting device as a result of passing through the at least one diffusive screen. The method comprises replacing the at least one diffusive screen with a diffusive screen having a different pattern of geometric features, thus varying the radiation pattern of the light radiation emitted by the lighting device.

Various embodiments may generate, from a—for example LED—light radiation source module of the linear type, a modulatable light beam form with the possibility of adapting the radiation pattern without having to change the light radiation source, the primary optical component and the housing.

Various embodiments may use screens or sheets of the diffusive type able to be mounted in and removed from the housing depending on the desired light pattern without having to change the light radiation sources and the primary optical component.

In various embodiments, it is possible to mount on the same holder a plurality of sheets so as to obtain different combinations of light radiation.

By means of various embodiments it is possible to achieve one or more of the advantages listed here below:

- possibility of generating with a linear array of light radiation sources, for example of the LED type, different radiation patterns using one or more diffusive screens; all without having to assemble and disassemble any other part of the lighting device: in particular it is possible to modify the angles of the beam simply and rapidly;
- possibility of obtaining different beam forms without having to modify the light sources and/or any collimating lenses associated therewith or, in the worst case, the entire module, being able to achieve instead the same result by inserting a given diffusive screen;
- possibility of proceeding by simply inserting a given diffusive screen, unlike that which occurs in linear systems using rows of single lenses or mirrors where, in order to change the form of the beam, it is required to replace individually each optical component or make use of a mechanical defocusing system;
- possibility of adapting to the same holder associated with an array of light radiation sources a range (assortment) of different diffusive screens;
- possibility of inserting and removing the diffusive screens by means of gripping elements arranged on the sides of the screens so as to be able to grip the screens firmly;
- possibility of using, for insertion of the screens, flat supports for maintaining a flat direction and stability, avoiding the risk of inclining or folding the screens and/or touching any part of the system (for example the light radiation sources or primary optical components);
- possibility of choosing one or more given diffusive screens in order to obtain the desired forms and dimensions of the beam, for example circular, oval, folded, narrow, medium-width, wide or other forms.
- possibility of housing more than one diffusive screen, with the consequent possibility of mixing the radiation patterns;
- possibility of adopting the same solution both for a single module and for an array of modules, depending on the application;
- possibility of joining together several modules both lengthwise and widthwise since the spaces provided in the holders and the tongues of the screens facilitate insertion and removal of the screens.

DETAILED DESCRIPTION OF THE DRAWINGS

In the following description various specific details aimed at providing a fuller understanding of the embodiments are described. The embodiments may be implemented using one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment. Moreover, particular forms, structures or characteristic features may be combined in any suitable manner in one or more embodiments.

The reference numbers used here are provided solely for the sake of convenience and therefore do not define the scope of protection or the range of application of the embodiments.

In the figures the reference number 10 denotes overall a lighting device comprising a housing 12 able to receive a light radiation source 14.

In various embodiments, the housing 12 may be obtained from a profiled part made of metallic or plastic material. In various embodiments, the material in question may be a material with good heat dissipation properties.

Figure 2:
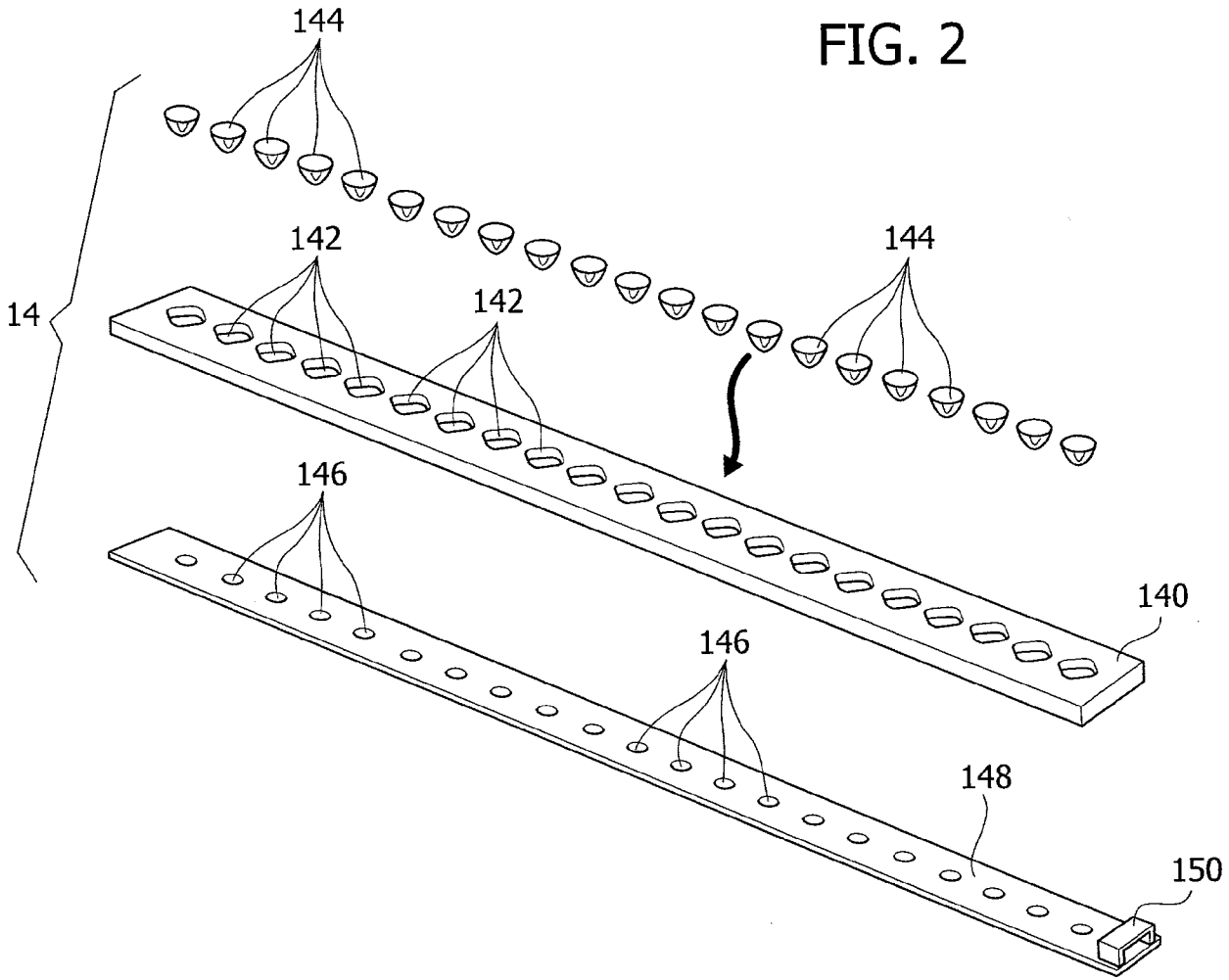
FIGS. 2, 3*a* , 3*b* and 3*c* show various details of embodiments.

In various embodiments, as can be seen more clearly in the exploded view of FIG. 2, the light radiation source 14 may consist of a holder with an elongated form 140 (which may also be made of plastic or metallic material with good heat dissipation properties) comprising a plurality of recesses 142 each able to receive a respective primary optical component 144 (for example a reflector made of molded material, for example with an approximately parabolic form, with a reflective inner surface), where each optical component 144 is intended to be associated with a respective light radiation source 146.

In various embodiments, the light radiation sources 146 may be LED light radiation sources, for example mounted on a printed circuit board (PCB) with an elongated form—denoted by 148—which also has a connector 150 for supplying the sources 146 with electric power.

Figure 1:
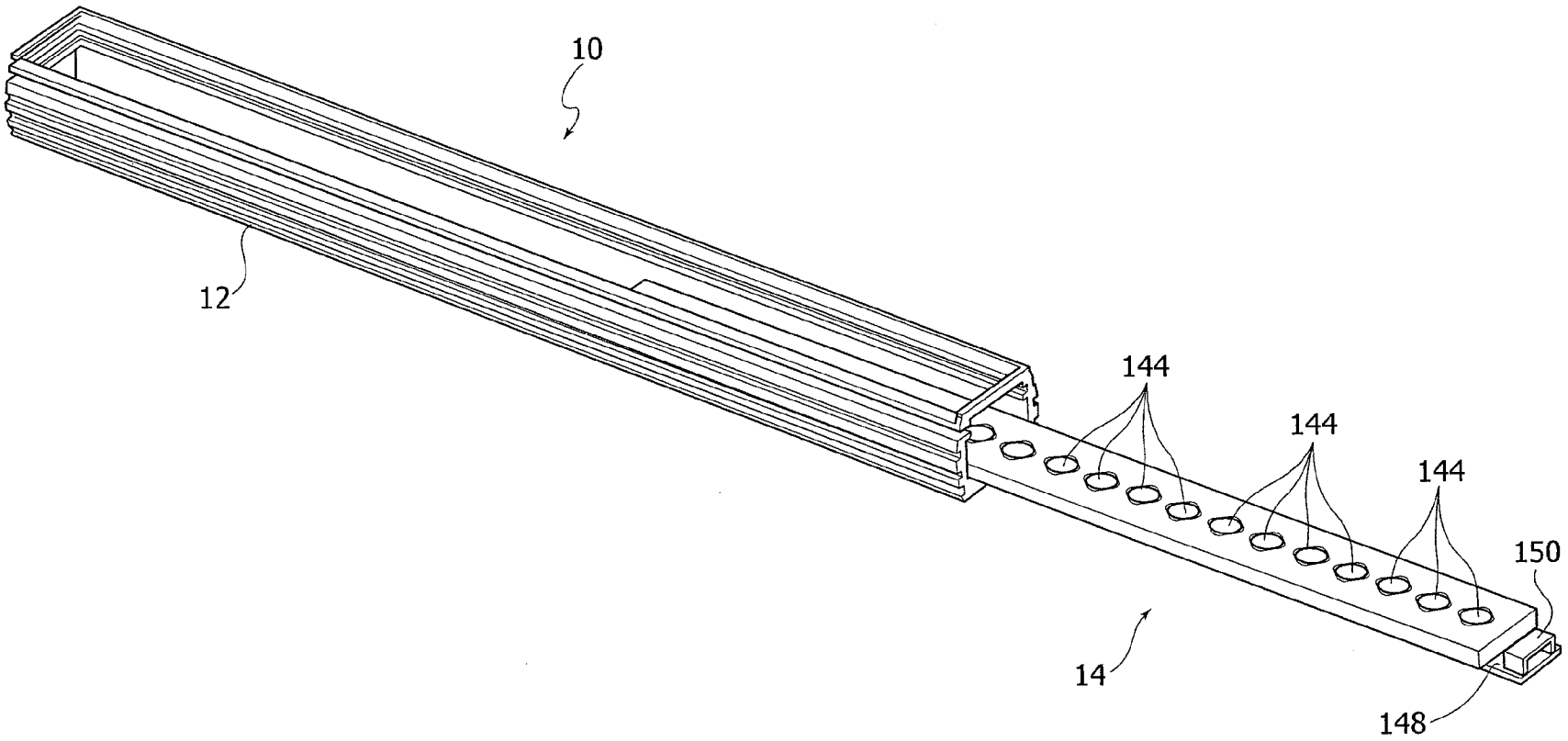
FIG. 1 is a general perspective view of an embodiment.

When assembled together, the various parts shown in the exploded view of FIG. 2 form a bar element which can be inserted inside the housing 12 as schematically shown in FIG. 1.

The embodiment shown in FIG. 2 is only one possible embodiment of a light array of light radiation sources which can be used in the embodiments. Other solutions which are able to achieve the same result are known in the art.

From the view shown in FIG. 1 it can also be noted that, in various embodiments, the housing 12 has a general channel-shaped configuration such as to allow the insertion inside it of the light radiation source 14 (which has a linear bar-like form), sliding it longitudinally inside the housing 12 along the bottom or core wall of the channel-shaped form of the housing 12.

The light radiation emitted by the radiation sources 146 emerges from the housing 12 through the open top wall, namely the mouth part, of the channel-shaped form.

From the view shown in FIG. 1 it can also be noted that, when inserted inside the housing 12, the source 14 is situated with its top or outer surface (i.e. surface which is directed towards the open mouth part of the channel-shaped form of the housing 12) situated at a certain distance, for example 5-10 mm, from the surface in which this mouth part lies.

Figure 3:
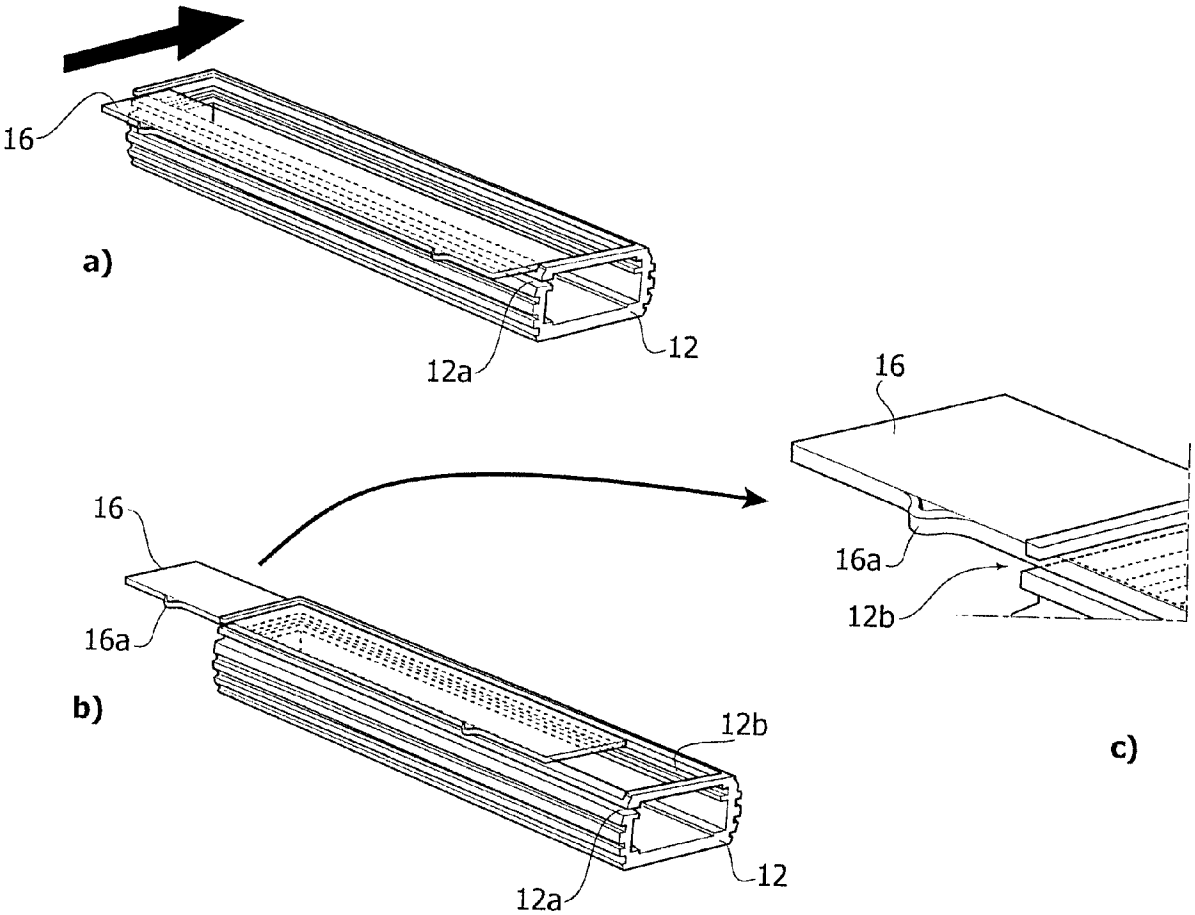
Figure 4:
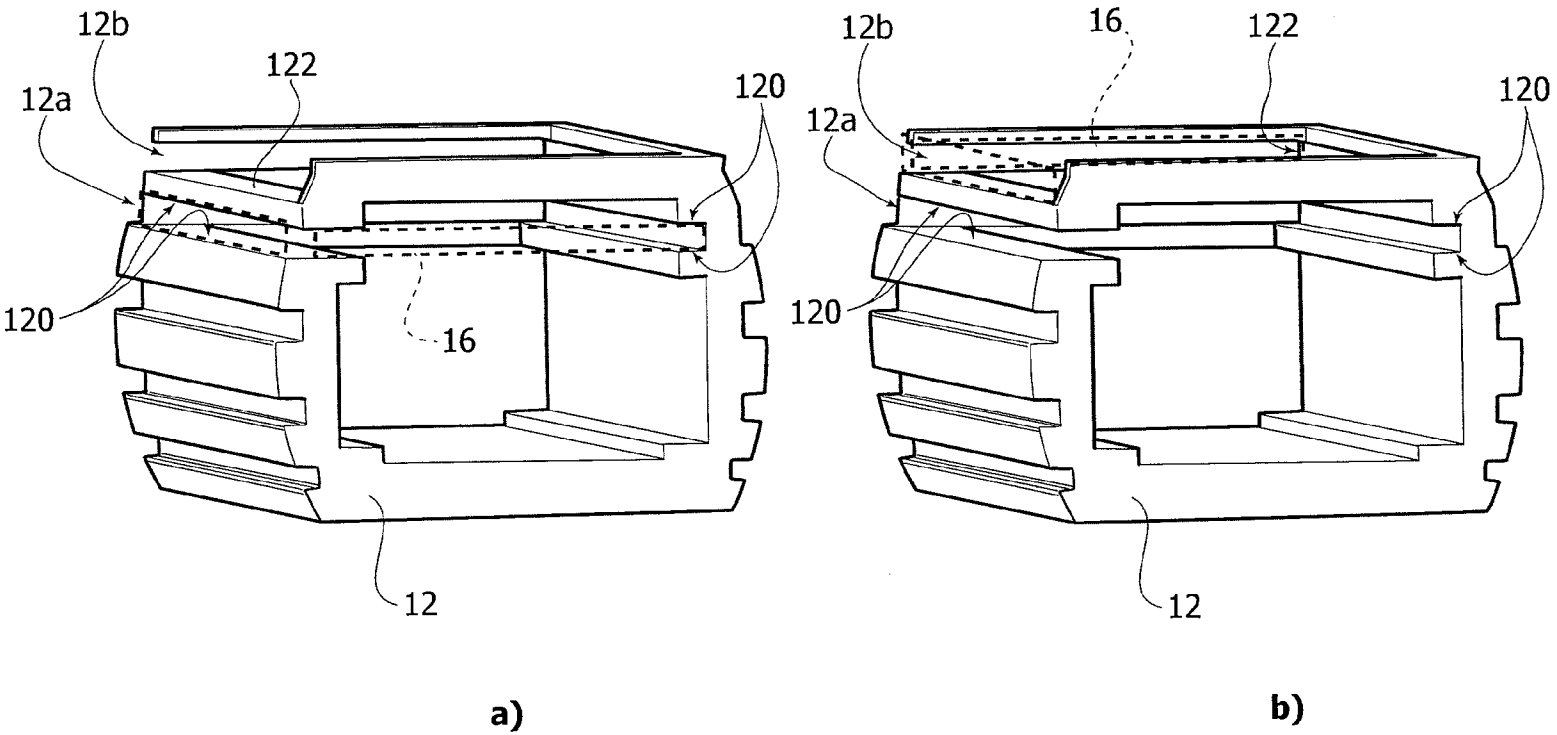
FIGS. 4*a* and 4*b* show characteristic features of embodiments in an ideal cross-sectional view.

In this way, as schematically shown in the views of FIG. 3, and even more clearly in the cross-sectional views of FIG. 4, the housing 12 may have, along its mouth part, one or more slots which allow insertion of one or more diffusive screens 16 inside the channel-shaped body of the housing 12.

In particular, in the examples of embodiment considered here, which are so designed, the following may be provided:

- a first longitudinal slot—denoted by 12*a*—intended to allow insertion of a first screen 16 which is slid, as shown in the part of FIG. 3 indicated by a), "crosswise" with respect to the housing 12; and
- a second end slot—denoted by 12*b*—intended to allow insertion of a second screen 16 which is slid, as shown in the part of FIG. 3 indicated by b), "lengthwise" with respect to the housing 12.

These insertion operations may be facilitated by providing, along the side walls of the channel-shaped form of the housing 12, flat surfaces 120 and 122 acting as flat supports for maintaining the exact direction of the (sheet-like) screens 16, allowing them to be inserted into and removed from the housing 12 in a stable condition.

As can be seen more clearly in the part of FIG. 3 indicated by c), the screens 16 may be advantageously provided with gripping formations 16*a*, for example in the form of a tongue, which allow them to be gripped for the purpose of inserting and removing them into/from the housing 12 without touching either the surface of the screens 16 (made usually of an optical-grade material, for example transparent plastic) or other parts of the device 10, for example the light source 14 and in particular the optical components 144 associated with the latter.

The presence of several slots or grooves 12*a*, 12*b*, with the possibility of using each of them depending on the modes of insertion of the screens 16, i.e. with a transverse movement or with a longitudinal movement relative to the housing 12, therefore constitutes an advantageous but not obligatory feature for the purposes of implementation of the embodiments.

Various embodiments may envisage the insertion in the device 10 of only a single screen 16; the presence of several diffusive screens 16 therefore does not constitute an obligatory feature. In a similar manner, the possibility of inserting a first screen 16 inside the slot 12*a* with a transverse sliding movement, i.e. in the direction perpendicular to the main direction of extension of the housing 12, and a second screen 16 inside the slot 12*b* with a longitudinal sliding movement, i.e. in the direction of greater extension of the housing 12, constitutes once again an option, but not an obligatory feature.

Figure 5:
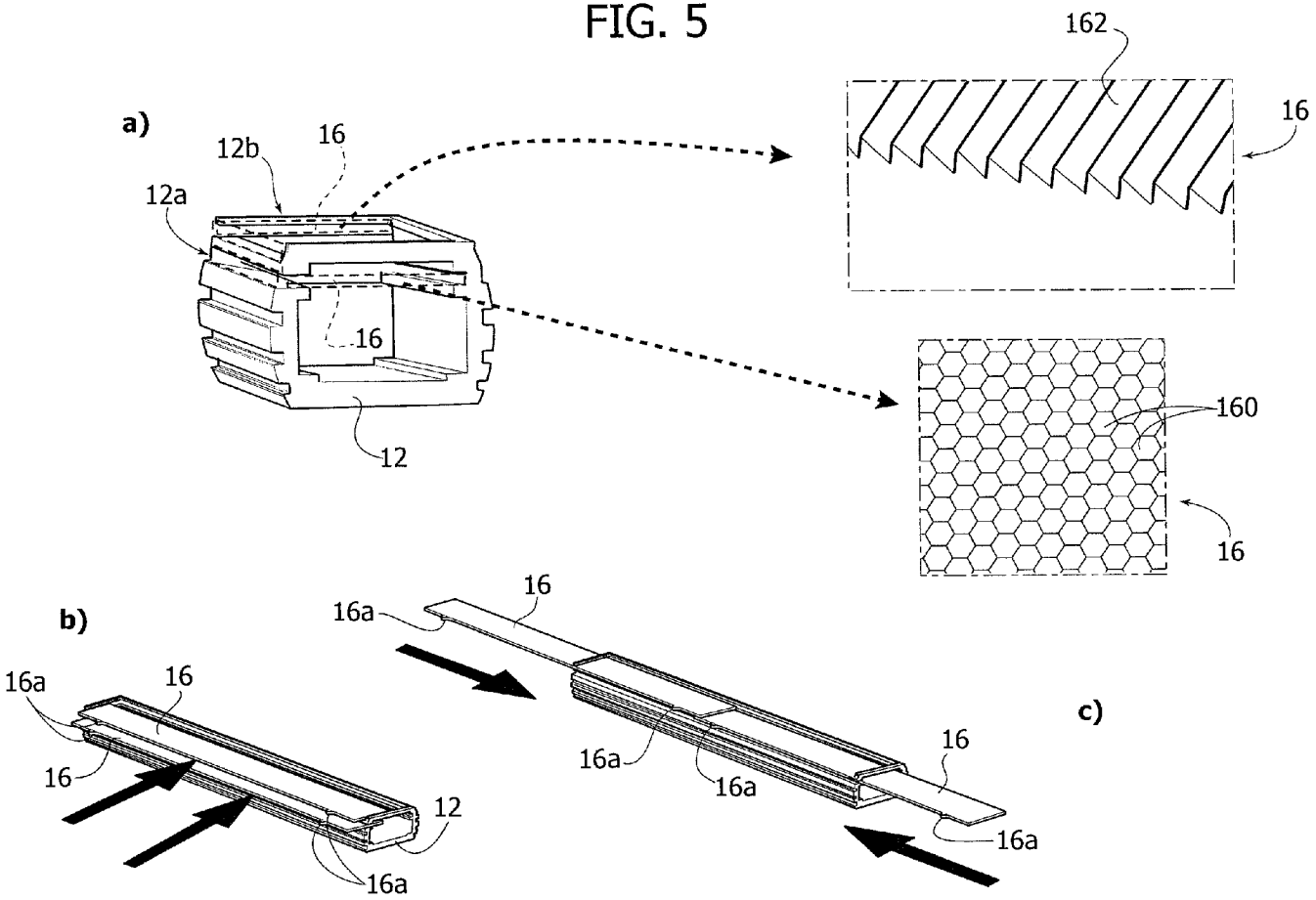
FIGS. 5*a*, 5*b* and 5*c* show schematically the modes of use of various embodiments.

The part of FIG. 5 indicated by b) furthermore illustrates the possibility, in various embodiments, of inserting two screens 16 inside the housing 12, sliding both of them in the transverse direction with respect to the housing 12, while the part of the same FIG. 5 indicated by c) illustrates the possibility, in various embodiments, of inserting two screens 16 inside the housing 12, sliding both of them in the longitudinal direction with respect to the housing 12.

Figure 6:
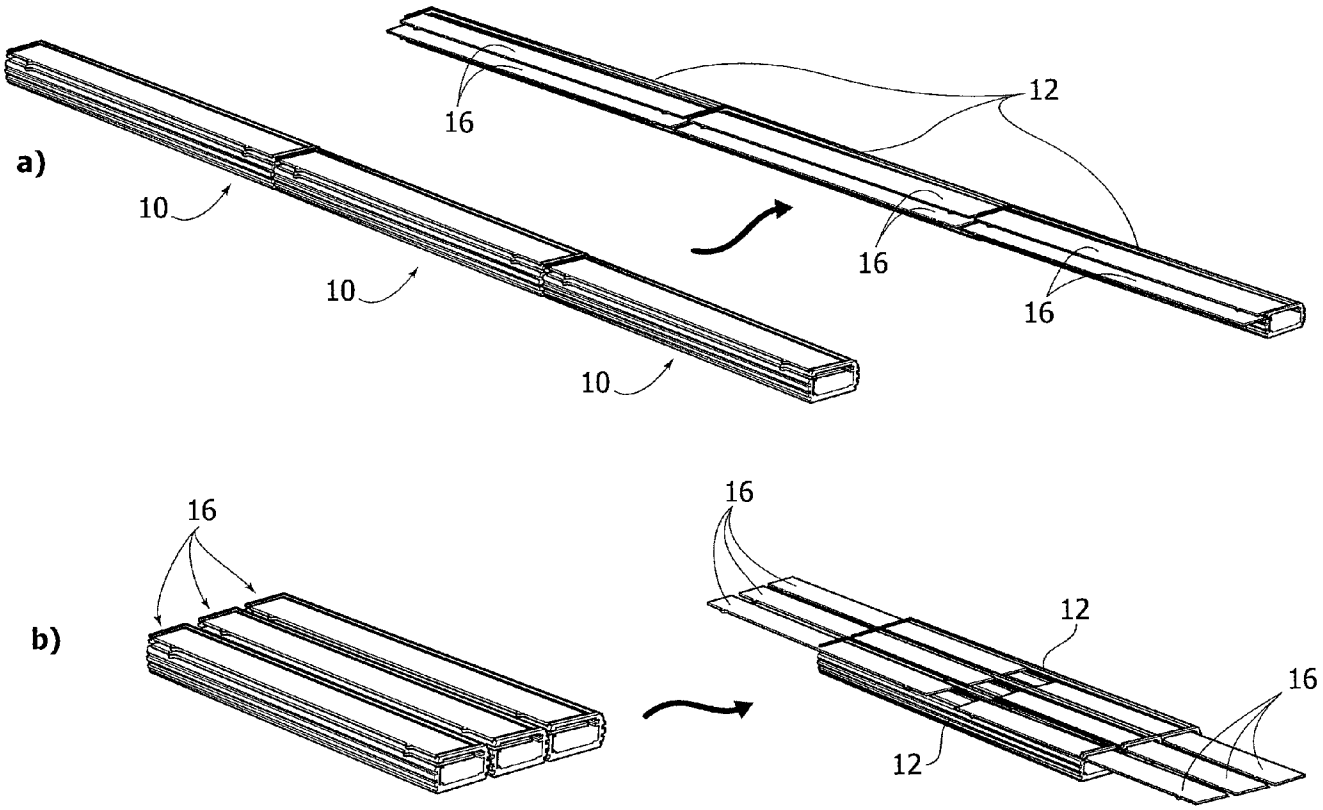
FIGS. 6*a* and 6*b* show schematically various ways of combining embodiments.

These different insertion modes may be used, for example, in order to join together several lighting devices 10 as schematically shown in FIG. 6.

Thus, for example, the part of FIG. 6 indicated by a) refers to the possibility of aligning lengthwise a plurality of devices 10 (for example three devices 10).

In this case the insertion of the screen or screens 16 inside the housing 12 of each device 10 may be performed with a lateral movement as shown in particular on the right-hand side in the part of FIG. 6 indicated by a).

The part of FIG. 6 indicated by b) instead refers to the possibility of arranging alongside each other a plurality of devices 10 (for example three devices 10).

In this case the insertion of the screen or screens 16 inside the housing 12 of each device 10 may be performed with a longitudinal movement as shown in particular on the right-hand side in the part of FIG. 6 indicated by b).

Since they are arranged facing the array 14 of light radiation sources 146, the screen or screens 16 are passed through by the light radiation emitted by the light radiation sources 146. The pattern of geometric features of the screen or screens 16 therefore determines the radiation pattern of the light radiation output from the device 10.

The geometric features of the diffusive screens 16 define the optical behavior of the said screens and therefore the shaping effect of the light beam emerging from the device. By replacing each screen with a diffusive screen 16 having a different pattern of geometric features it is therefore possible to vary the radiation pattern of the light radiation emitted by the lighting device.

By way of example, the aforementioned geometric features of the diffusive screens 16, intended to define the optical behavior of each screen 16, may be represented (as schematically shown in part a) of FIG. 5) by:

- lens-like features, for example with lens-like forms 160 having a hexagonal or cylindrical, polygonal, or other shape and/or
- surface sculpturing features 162, such as sculpturing with a finned profile having a sawtooth profile (roughly comparable to the form of the component parts of a Fresnel lens).

Thus, as already mentioned, the screens 16 may be made of an optical-grade material, for example transparent molded plastic.

Figure 7:
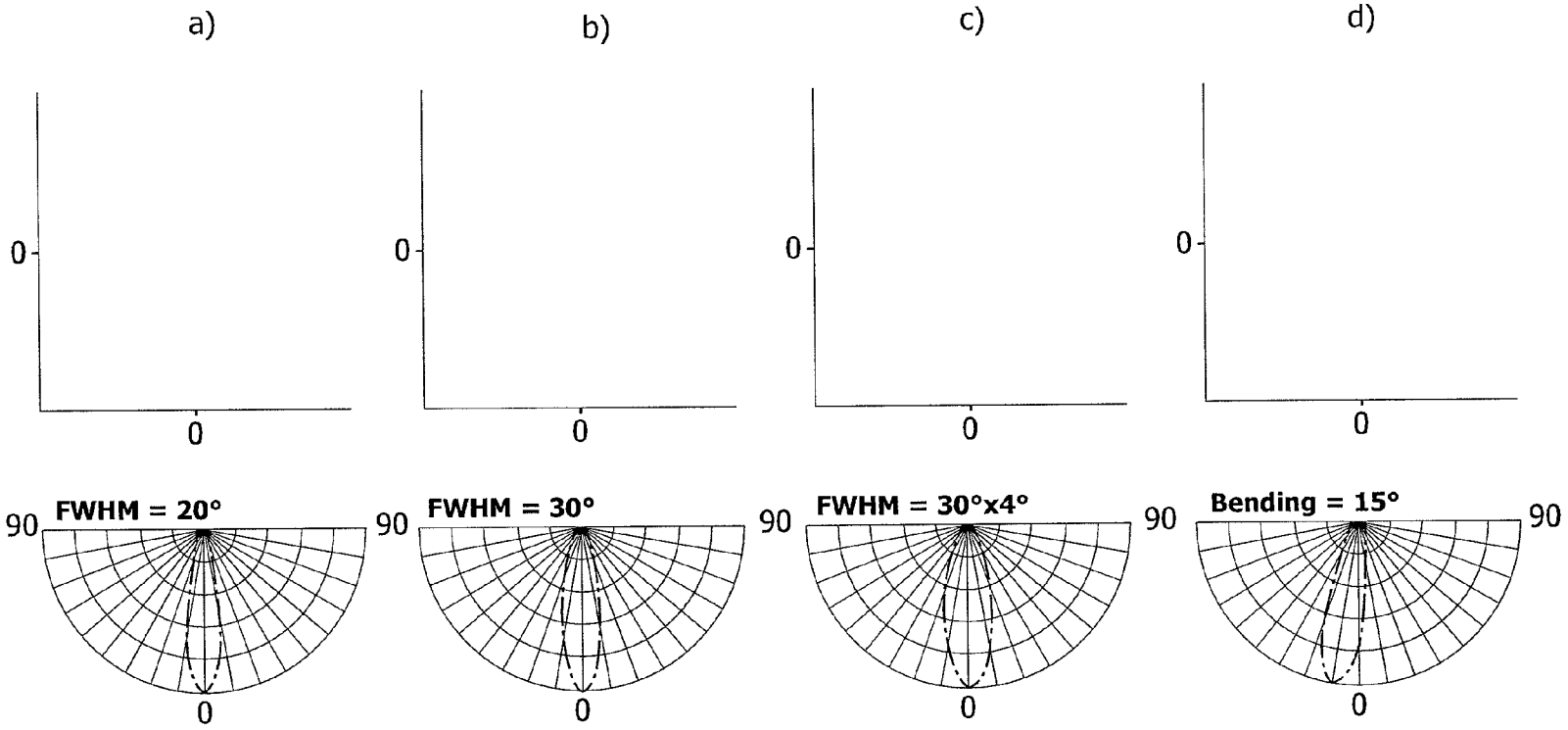
FIGS. 7*a*, 7*b*, 7*c* and 7*d* show the results which can be achieved in various embodiments.

FIG. 7, comprising four parts indicated by a), b), c) and d), shows schematically different patterns or forms of a (FWHM=Full Width at Half Maximum) light radiation beam emitted by a device 10 depending on the different choice of the screen or screens 16 mounted on the housing 10.

The geometric features of the screen or screens mounted on the housing 12 determine in fact the light radiation form of the radiation emitted by the device 10. Since the screen or screens 16 are mounted on the housing 12 with the housing 12 in such way that they may be replaced, by replacing a diffusive screen 16 with a diffusive screen 16 which has a different layout of optical features it is possible to vary the radiation pattern of the light radiation emitted by the device 10.

This result may be achieved by using also a single diffusive screen 16 chosen from among an assortment of screens with different geometric features. The possibility of mounting two (or in some cases more) screens 16 which may be replaced individually with different screens provides the system described with an even greater flexibility as regards the possibility of the results which can be achieved.

Obviously, without affecting the principle of the invention, the embodiments and the constructional details may vary, also significantly, with respect to that illustrated here purely by way of a non-limiting example, without thereby departing from the scope of protection of the invention; this protective scope is defined by the accompanying claims.

The invention claimed is:

1. A lighting device comprising:

a housing configured to carry a linear array of light radiation sources, said housing being configured such that the housing is connectable to at least one other said housing; and a first elongated diffusive screen and a second elongated diffusive screen, each of said first and second elongated diffusive screens being arranged facing said array of light radiation sources so as to be passed through by the light radiation emitted by said array of light radiation sources, each of said first and second elongated diffusive screens having a pattern of geometric features configured to produce a radiation pattern of the light radiation emitted by said lighting device, each of the first and second elongated diffusive screens having, protruding from only a portion of an edge thereof, a grip, wherein:

said housing comprises an elongated holder that slidably receives and replaceably supports each of said first and second elongated diffusive screens to enable replacement of respective ones of said first and second elongated diffusive screens with a diffusive screen having a different pattern of geometric features so as to vary the radiation pattern of the light radiation emitted by said lighting device, and said elongated holder is configured to slidably receive said first elongated diffusive screen and said second elongated diffusive screen such that said first elongated diffusive screen is insertable lengthwise with respect to the elongated holder and said second elongated diffusive screen is insertable crosswise with respect to the elongated holder, and said housing is connectable to said at least one other said housing by at least one of said first and second elongated diffusive screens.

2. The device as claimed in claim 1, wherein said elongated holder is configured to slidably receive said linear array of light radiation sources.

3. The device as claimed in claim 1, wherein said geometric features are selected from among arrays of lens features and surface sculpturing features.

4. The device as claimed in claim 1, wherein said housing is connected to the at least one other said housing in at least one selected from the group consisting of lengthwise connection and side-by-side connection.

5. A method for varying the radiation pattern of the light radiation emitted by a lighting device comprising a housing, said housing being configured such that the housing is connectable to at least one other said housing, a linear array of light radiation sources, and first and second elongated diffusive screens, each of said first and second elongated diffusive screens arranged facing said array of light radiation sources so as to be passed through by the light radiation emitted by said array of light radiation sources, each of said first and second elongated diffusive screens having a pattern of geometric features for producing said radiation pattern of the light radiation emitted by said lighting device as a result of passing through said first and second elongated diffusive screens, each of the first and second elongated diffusive screens having, protruding from only a portion of an edge thereof, a grip, the housing having an elongated holder that slidably receives and replaceably supports each of said first and second elongated diffusive screens, the elongated holder being configured to slidably receive said first elongated diffusive screen and said second elongated diffusive screen such that said first elongated diffusive screen is insertable lengthwise with respect to the elongated holder and said second elongated diffusive screen is insertable crosswise with respect to the elongated holder, the method comprising replacing, by lengthwise and crosswise insertion into the elongated holder, respective ones of the first and second elongated diffusive screens with a diffusive screen having a different pattern of geometric features so as to vary the radiation pattern of the light radiation emitted by the lighting device, and connecting said housing to the at least one other said housing by at least one of said first and second elongated diffusive screens.

6. The method as claimed in claim 5, wherein said housing is connected to the at least one other said housing in at least one selected from the group consisting of lengthwise connection and side-by-side connection.

* * * * *